US007036419B2

(12) United States Patent
Vallier

(10) Patent No.: US 7,036,419 B2
(45) Date of Patent: May 2, 2006

(54) ADAPTER DEVICE FOR PROJECTILE FIRED FROM A LAUNCHING TUBE

(75) Inventor: Marc Vallier, Savigny sur Orge (FR)

(73) Assignee: MBDA, (FR)

( * ) Notice: Subject to any disclaimer, the term of this patent is extended or adjusted under 35 U.S.C. 154(b) by 0 days.

(21) Appl. No.: 10/519,615

(22) PCT Filed: Jun. 26, 2003

(86) PCT No.: PCT/FR03/01978

§ 371 (c)(1),
(2), (4) Date: Dec. 23, 2004

(87) PCT Pub. No.: WO2004/003461

PCT Pub. Date: Jan. 8, 2004

(65) Prior Publication Data

US 2005/0242230 A1 Nov. 3, 2005

(30) Foreign Application Priority Data

Jun. 28, 2002 (FR) ..... 02 08082

(51) Int. Cl.
*F41F 3/04* (2006.01)

(52) U.S. Cl. ..... 89/1.816; 89/47

(58) Field of Classification Search ..... 89/1.801, 89/1.802, 1.815–1.819, 47, 45; 244/3.24–3.3
See application file for complete search history.

(56) References Cited

U.S. PATENT DOCUMENTS

| | | | | | |
|---|---|---|---|---|---|
| 2,802,399 | A | * | 8/1957 | Little | 89/1.816 |
| 2,961,928 | A | * | 11/1960 | Rosenthal | 89/1.816 |
| 2,974,593 | A | * | 3/1961 | Bitner et al. | 244/3.24 |
| 3,160,060 | A | * | 12/1964 | Lorant et al. | 89/1.816 |
| 3,438,303 | A | * | 4/1969 | Tosti et al. | 89/1.818 |
| 3,750,578 | A | * | 8/1973 | Blajda | 102/436 |
| 3,754,497 | A | * | 8/1973 | Rusbach | 89/1.814 |
| 4,011,794 | A | * | 3/1977 | Leshem | 89/47 |
| 4,432,269 | A | * | 2/1984 | Castagner et al. | 89/1.816 |
| 4,709,614 | A | * | 12/1987 | Klumpp | 89/1.35 |
| 5,780,766 | A | * | 7/1998 | Schroppel | 102/372 |
| 6,305,544 | B1 | * | 10/2001 | Shacklee | 206/509 |

FOREIGN PATENT DOCUMENTS

FR 1567933 A2 * 5/1969

* cited by examiner

*Primary Examiner*—Galen Barefoot
(74) *Attorney, Agent, or Firm*—Thelen Reid & Priest LLP

(57) ABSTRACT

An adapter device (10) is used in order to allow a projectile (12), such as missile, to be launched from a standard launching tube (14), without having to modify the latter. This device comprises an adapter tube (24) in which the projectile (12) is placed, a retaining ring (22) which is mounted on the end of the launching tube (14) and a hooking system (26) for securing the adapter tube (24) to the launching tube. The adapter tube (24) has a front portion (38) provided with grooves for guiding the folded fins of the projectile (12) and a rear portion provided with a bottom onto which is fixed a pulley (36) for returning an optical fiber (20) used for guiding the projectile (12).

11 Claims, 3 Drawing Sheets

ADAPTER DEVICE FOR PROJECTILE FIRED FROM A LAUNCHING TUBE

CROSS-REFERENCE TO RELATED APPLICATION

This application claims priority based on International Patent Application No. PCT/FR03/01978, entitled "Adapter Device For Projectile Launched From A Launching Tube" by Marc VALUER, which claims priority of French Application No. 02 08082, filed on Jun. 28, 2002, which was not published in English.

DESCRIPTION OF TECHNICAL DOMAIN

The invention concerns an adapter device for use in association with a projectile with deployable fins, such as a missile, to allow such a projectile to be fired from a launching tube of small diameter, such as a mortar or cannon tube.

The invention especially enables projectiles guided by optical fibres, or the like, to be fired from a launching-tube of standard dimensions, without having to modify the latter.

PRIOR ART

As evident especially from the document U.S. Pat. No. 4,907,763, it is known to fire a projectile guided by a cable or an optical fibre, from a mortar or cannon tube.

In this case, the projectile is guided in flight by deployable fins which lodge before firing in recesses provided for this purpose in the external envelope of said projectile. This arrangement implies mounting the fins on the envelope by means of complex articulated mechanisms. In addition, the presence of recesses in the external envelope of the projectile results in a reduction in the useful volume available inside the envelope of the projectile.

DESCRIPTION OF THE INVENTION

The object of the invention is an adapter device designed to allow a projectile such as a missile to be launched from a standard launching tube of small diameter, such as a mortar or cannon tube, without modification to said tube and without the necessity for housings or complex articulations for mounting the guide fins on the external envelope of the projectile.

According to the present invention, this result is obtained by means of an adapter device designed to be interposed between a projectile, fitted with deployable fins, for occupying a folded position, and a standard launching tube, said device being characterised in that it comprises a retaining ring for being mounted on an open end of the launching tube, an adapter tube for being placed around the projectile, such that in their folded position the fins are lodged in a first part of the adapter tube, and hooking means of the adapter tube on the retaining ring, in a position such that the first part of the adapter tube is located outside the launching tube and a second part of the adapter tube is received in the launching tube.

Utilisation of the adapter device according to the present invention allows projectile fitted with deployable fins to be fired from a standard launching tube whereof the internal diameter is slightly greater than the internal diameter of the body of the projectile, without it being necessary to modify the launching tube. In effect, the retaining ring mounted on the launching tube serves to anchor the hooking means of the adapter tube in which the projectile is placed. Mounting of the retaining ring on the launching tube can especially be completed by friction, by giving said ring the form of a split ring which is clamped by means of a bolt interposed between its ends. The folded fins of the projectile are received in the part front of the adapter tube, which acts as guidance for the projectile when launched.

According to a preferred embodiment of the invention, the first part of the adapter tube comprises longitudinal guide grooves terminating inside the adapter tube, so as to Be capable of receiving each of the fins of the projectile.

In this case, the first part of the tube advantageously comprises longitudinal external grooves and each of said longitudinal guide grooves is formed in the corresponding one of said longitudinal external grooves.

According to an advantageous realisation of the invention, the first part of the tube comprises an external ring adjacent to the second part of the adapter tube and capable of being supported against an open end of the launching tube.

Advantageously, the hooking means are then interposed between the retaining ring and the external ring of the adapter tube.

In this case, the hooking means can especially comprise dunking mechanisms.

According to an advantageous refinement, the device also comprises mobile transport elements including a front protective cap and a back protective cap, suitable for being placed respectively on the front and back ends of the projectile covered by the adapter tube, and a transport sling connecting said protective caps.

Preferably, an open end of the adapter tube, opposite the second part of the latter, is provided for placing behind auxiliary propulsion units of the projectile.

Advantageously, the projectile is a missile guided by an optical fibres.

In this case, the adapter tube generally comprises a closed end, opposite the first part of the latter, and a pulley for returning the optical fibre, mounted inside said closed end.

Finally, the launching tube is advantageously a mortar tube.

BRIEF DESCRIPTION OF THE DRAWINGS

A preferred embodiment of the invention will now be described, by way of illustrative and non-limiting example, with reference to the attached diagrams, in which.

DETAILED DESCRIPTION OF A PREFERRED EMBODIMENT

In the overall description, the terms "front" and "back" are a reference respectively to the front and the back of the projectile placed in the launching tube by means of the adapter device.

Figure 1:
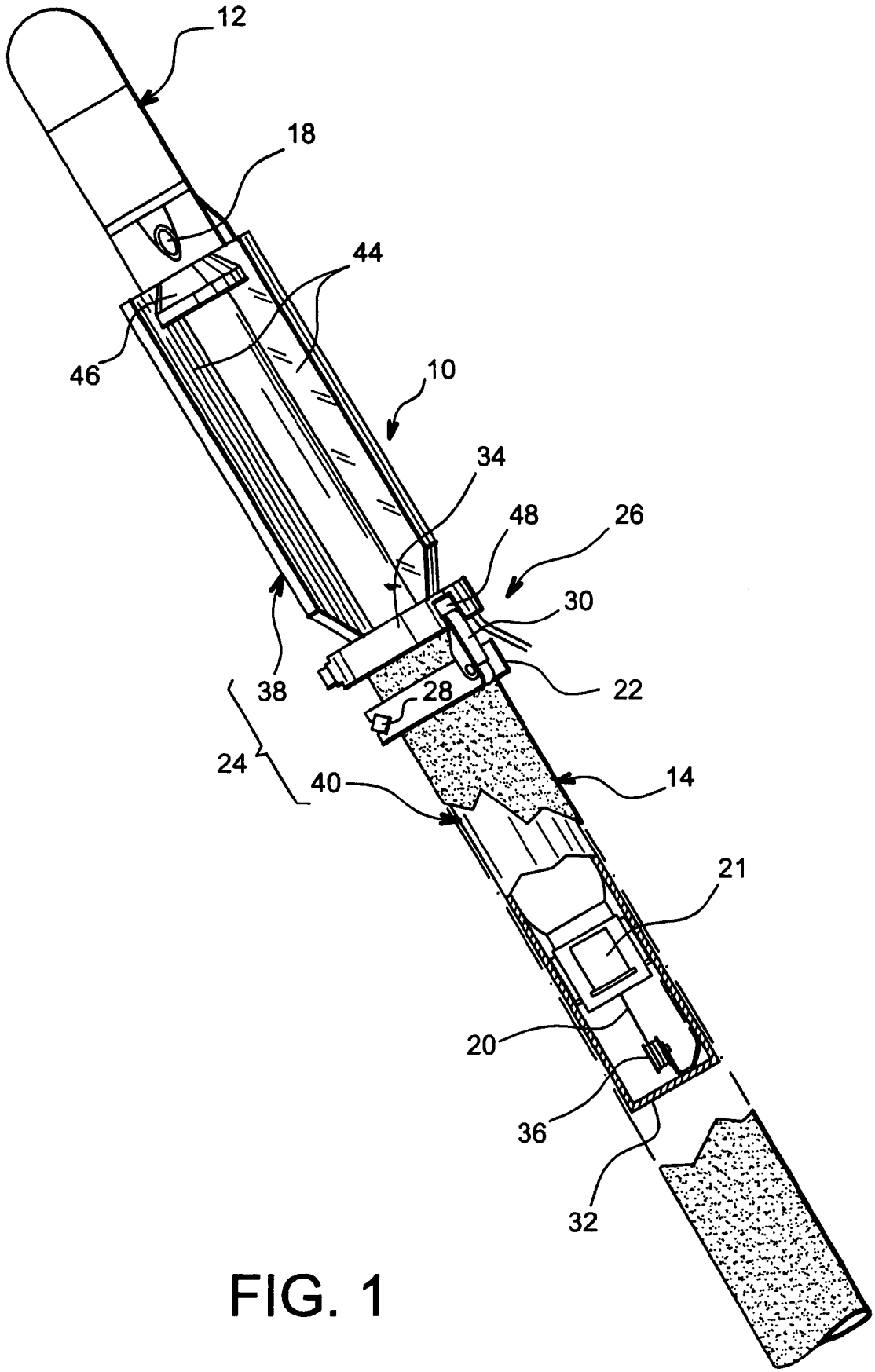
FIG. 1 is a perspective view showing a projectile to be launched from a launching tube, an adapter device according to the present invention being interposed between the projectile and the tube.

As is illustrated schematically in FIG. 1, the invention concerns an adapter device 10 provided to be interposed between a projectile 12 such as a missile guided by an optical fibre and a standard launching tube 14 such as a mortar tube, so as to enable the projectile 12 to be launched without the necessity of modifying the launching tube.

More precisely, the projectile 12 comprises a cylindrical body, on which are articulated fins 16 (FIG. 2) suitable for occupying a folded position illustrated in full lines and a deployed position (not shown). In the non-limiting embodiment shown in the figures, there are four fins 16, evenly spaced on the circumference of the body of the projectile. Each of the fins 16 is plane and situated in a plane passing through the longitudinal axis of the body of the projectile.

Relative to its axis of articulation 18 on the body of the projectile, each fin 16 is suited to be folded to the front of the projectile 12, such that its edge turned to the front when the fins are deployed abuts against the circumferential surface of the body of the projectile when the fins 16 are folded.

As is also evident from FIG. 1, the projectile 12 also comprises trimming propulsion units 18 (for example two) which join on the circumferential surface of the body of the projectile, at the front of the fins 16 when the latter are in the folded position.

As indicated above, the projectile 12 is guided by an optical fibre 20 utilised, in a known manner, to ensure the transmission of information between said projectile and a command post (not shown), after the projectile has been launched.

The optical fibre 20 is stored on a bobbin 21 placed in the back part of the body of the projectile 12. It exits from said body via a central orifice formed on the back face of the latter. The optical fibre 20 then travels along the internal wall of the tube 14 or outside the body of the projectile 12, according to a trajectory which will be specified hereinbelow, before emerging via the open end of the launching tube 14 to rejoin the command post.

The adapter device 10 according to the present invention essentially comprises a retaining ring 22, provided to be fixed on the open end of the launching tube 14, an adapter tube 24 designed to be placed around the body of the projectile 12 and hooking means 26 of the adapter tube 24 on the retaining ring 22.

The retaining ring 22 is provided to be fixed by clamping on the launching tube 14, in the immediate vicinity of its open end, without having to modify or machine said tube. Thus, the retaining ring 22 can especially be a split ring whereof the ends can be joined to one another by a rapid clamping device such as a bolt 28. The effect of the clamping of the bolt 28 is to secure the retaining ring 22 of the end of the launching tube 14 by friction. On its external surface the retaining ring 22 carries a part of the hooking means 26 for immobilising the adapter tube 24 relative to said ring when a ensemble of projectile 12 and adapter tube 24 is placed on the launching tube 14. In the embodiment show by way of example in the figures, said part of the hooking means 26 comprises two dunking mechanisms 30 mounted in emplacements diametrically opposite on the surface external of the retaining ring 22.

As shown in FIG. 1, the adapter tube 24 is a tube having a length slightly less than that of the projectile 12 and whereof the internal diameter is uniform and slightly greater than the external diameter of the body of the projectile. The end front of the adapter tube 24 is open while the back end of said tube is closed by a base 32.

Therefore, the adapter tube 24 can be placed around the body of the projectile 12, such that the front end of the projectile 12 projects over a certain length over the open front end of the adapter tube 24. The back end of the projectile 12 is then situated inside the adapter tube 24, at a certain distance from the base 32 of said tube. The latter distance is determined by an external ring 34, an integral part of the adapter tube 24, coming to rest against the open front end of the launching tube 14.

As shown in FIG. 1, this arrangement enables a pulley 36 for returning the optical fibre 20 to be mounted on the inner face of the base 32 of the adapter tube 24. On leaving the end back of the projectile 12, the optical fibre 20 travels on the return pulley 36 and returns to the open front end of the launching tube 14, between the adapter tube 24 and the projectile 12, to then be directed to the command post (not shown).

More precisely, the part of the optical fibre 20 which travels between the adapter tube 24 and the projectile 12 passes in a sleeve (not shown) provided for this purpose inside the adapter tube. This sleeve ensures mechanical and thermal protection of the optical fibre 20 during launch of the projectile 12.

The external ring 34 is fitted on one hand with hooking means 26 of the adapter tube 24 on the launching tube 12. In the embodiment shown, this other part of the hooking means 26 comprises two hooks 48 located in emplacements diametrically opposite on the surface external of said external ring 34. The dunking mechanisms 30 mounted on the retaining ring 22 are arranged so as to be able to engage in the hooks 48 when the adapter tube 24 is placed in the launching tube 14. The adapter tube 24 is then immobilised relative to the launching tube 14.

The external ring 34 is situated substantially in the centre of the adapter tube 24 and separates the latter in a first part 38, located in front of said external ring and a second part 40 located in back of said external ring.

The first part 38 of the adapter tube 24 comprises longitudinal guide grooves 42 (FIG. 2) whereof each is provided to receive one of the fins 16 of the projectile 12. More precisely, each of the longitudinal guide grooves 42 is formed in a longitudinal external groove 44 of the adapter tube 24 and is attached inside said tube over its entire length. In addition, the number and the distribution of the grooves 44 around the adapter tube 24 and the number and the distribution of the fins 16 around the body of the projectile 12 are identical. In the embodiment represented, there are four fins 16 and four grooves 44, evenly distributed around the body of the projectile 12 and around the adapter tube 24, respectively. Each of the longitudinal guide grooves 42 likewise is attached at its front end, such that the projectile can be introduced into and withdrawn from the adapter tube 24 via the front of the latter.

The front end of the first part 38 of the adapter tube 24 is reinforced by a segmented external ring 46 between the longitudinal external grooves 44.

The second part 40 of the adapter tube 24, situated at the back of the external ring 34, has a uniform external diameter, slightly less than the inner diameter of the launching tube 14 from which the projectile must be fired. Accordingly, the second part 40 of the adapter tube 24 can be introduced via the open front end of the launching tube 14, after the retaining ring 22 has been mounted on the launching tube 14.

Figure 2:
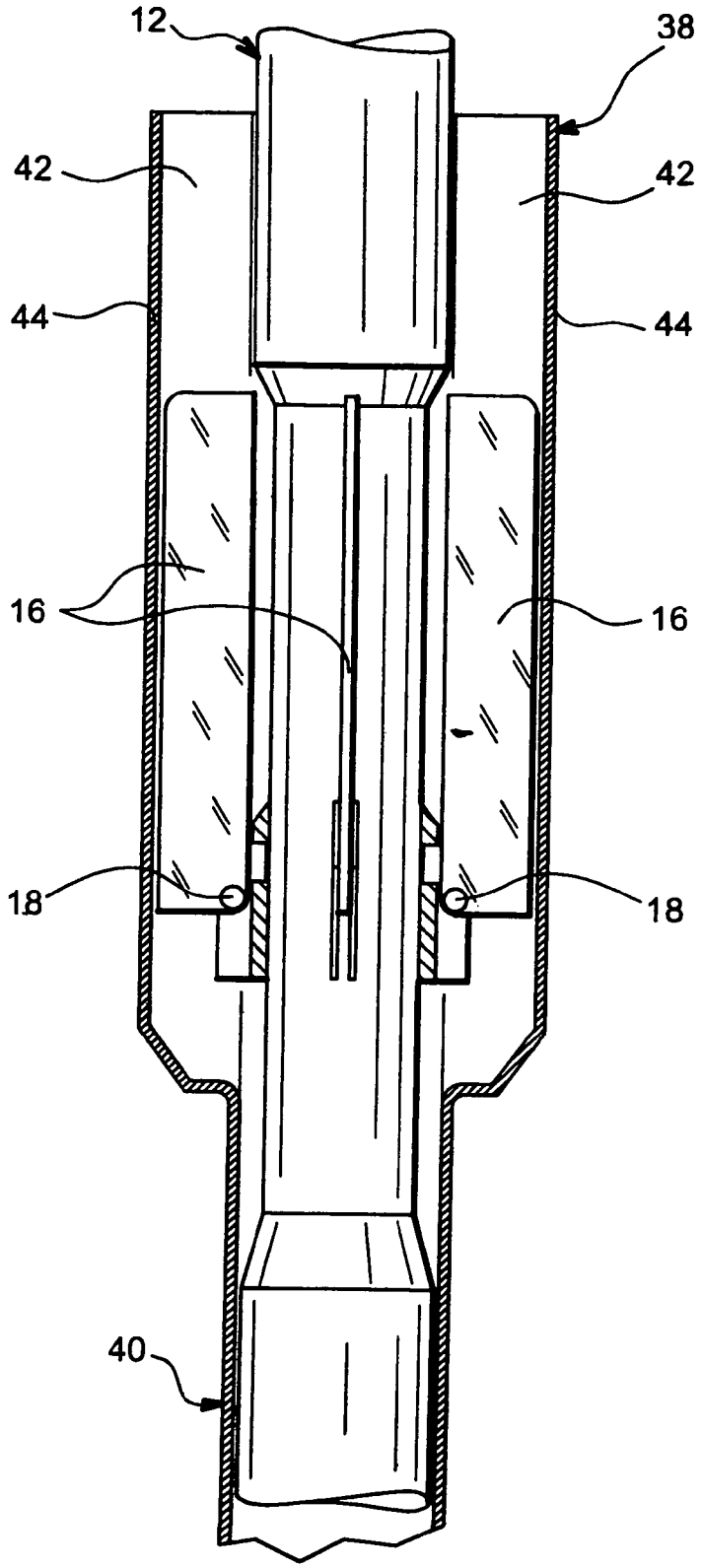
FIG. 2 is a view in longitudinal section on a larger scale, showing especially the fins of the projectile taken up in grooves provided for this purpose in the adapter tube.

Because of the arrangement which has just been described in reference to FIGS. 1 and 2, it is possible to launch a projectile 12 guided by optical fibre 20 and fitted with external fins 16 which can fold but not extended inside the body of the projectile, from a launching tube 14 not provided to this end, without any modification to said tube.

This result is made possible due to the utilisation of an adapter tube 24 serving as interface between the projectile 12 and the launching tube 24 and due to assembly of a retaining ring 22 on the launching tube 14, the adapter tube 24 easily able to be fixed to the retaining ring 22 by the hooking means 26.

The grooves 44 formed on the part front of the adapter tube 24 are utilised to ensure the guidance of the folded fins 16 of the projectile 12, during its launch. The trimming propulsion units 18 are then placed before the segmented external ring 46 which delimits the front end of the part front of the adapter tube 24. The jets emitted by these propulsion units 18 then rest on said ring 46 during firing.

Figure 3:
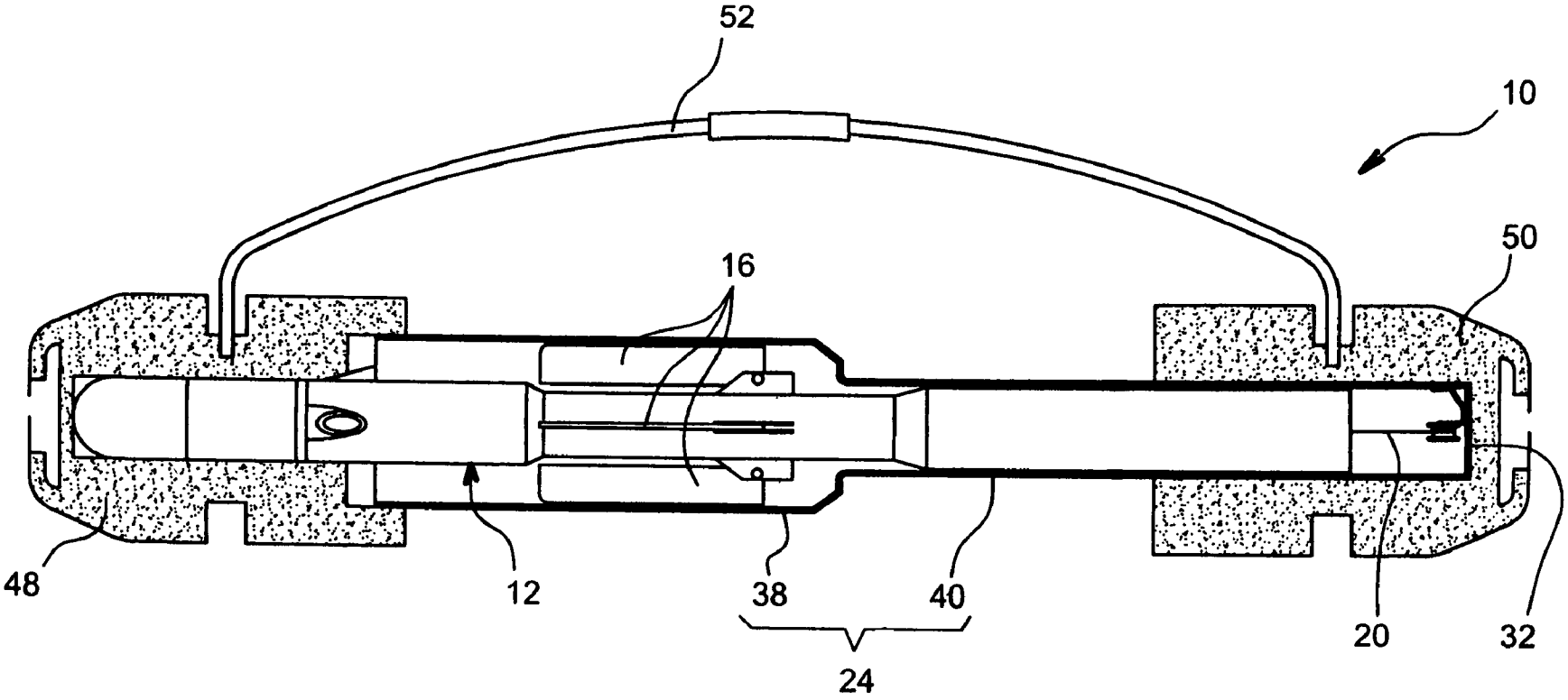
FIG. 3 is a side elevation schematically showing the protective caps and the transport sling of the projectile place in its adapter tube.

As illustrated in FIG. 3, the ensemble formed by the projectile 12 and by the adapter device 10 is provided to be easily transported to the launch site, where the launching tube 14 is located.

For this purpose, the adapter device 10 further comprises a front protective cap 48, provided to be placed on the end front of the projectile 12, a protective cap back 50, provided to be placed on the back end of the adapter tube 24, closed by the base 32, and a transport sling 52, which connects the protective front 48 and back caps 50. The caps 48 and 50 form with the sling 52 mobile transport elements of the ensemble made up by the projectile 12 and its adapter tube 24. These mobile transport elements are discarded on arrival at the launch site.

The invention claimed is:

1. An adapter device (10) designed to be interposed between a projectile (12), fitted with deployable fins (16), suitable for occupying a folded position, and a launching tube (14), said device being characterised in that it comprises a retaining ring (22) suited to being mounted on an open end of the launching tube (14), an adapter tube (24) suited to being placed around the projectile (12), such that the fins (16) in the folded position are lodged in a first part (38) of the adapter tube (24), and hooking means (26) of the adapter tube (24) on the retaining ring (22), in a position such that the first part (38) of the adapter tube (24) is situated outside the launching tube (14) and that a second part (40) of the adapter tube (24) is received in the launching tube (14).

2. The adapter device (10) as claimed in claim 1, wherein the first part (38) of the adapter tube (24) comprises longitudinal guide grooves (42) terminating inside the adapter tube (24), so as to be able to receive each of the fins (16) of the projectile (12).

3. The adapter device (10) as claimed in claim 2, wherein the first part (38) of the adapter tube (24) comprises longitudinal external grooves (44) and each of said longitudinal guide grooves (42) is formed in the corresponding one of said longitudinal external grooves (44).

4. The adapter device (10) according to claim 1, wherein the first part (38) of the adapter tube (24) comprises an external ring (34) adjacent to the second part (40) of the adapter tube (24) and capable of being supported against an open end of the launching tube (14).

5. The adapter device (10) as claimed in claim 4, wherein the hooking means (26) are interposed between the retaining ring (22) and the external ring (34) of the adapter tube (24).

6. The adapter device (10) as claimed in claim 5, wherein the hooking means (26) comprise dunking mechanisms (30).

7. The adapter device (10) according to claim 1, wherein said device further comprises mobile transport elements including a protective cap front (48) and a protective cap back (50), to be placed respectively on the front and back ends of the projectile (12) covered by the adapter tube (24), and a transport sling (52) connecting said protective caps (48, 50).

8. The adapter device (10) according to claim 1, wherein an open end of the adapter tube (24), opposite the second part (40) of the latter, is provided to be placed behind auxiliary propulsion units (18) of the projectile (12).

9. The adapter device (10) according to claim 1, wherein the projectile (12) is a missile guided by optical fibre (20).

10. The adapter device (10) as claimed in claim 9, wherein the adapter tube (24) comprises an end closed by a base (32), opposite the first part (38) of the latter, and a pulley (36) for returning the optical fibre (20), mounted inside said base (32).

11. The adapter device (10) according to claim 1, wherein the launching tube (14) is a mortar tube.

* * * * *